US008002557B2

(12) United States Patent
Lin et al.

(10) Patent No.: US 8,002,557 B2
(45) Date of Patent: Aug. 23, 2011

(54) SINK TYPE ELECTRICAL CONNECTOR WITH L-SHAPED FRAME

(75) Inventors: Nan-Hung Lin, Tu-Cheng (TW); Chun-Yi Chang, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/909,848

(22) Filed: Oct. 22, 2010

(65) Prior Publication Data

US 2011/0097908 A1 Apr. 28, 2011

(30) Foreign Application Priority Data

Oct. 22, 2009 (TW) ..... 98219495

(51) Int. Cl.
*H01R 12/00* (2006.01)

(52) U.S. Cl. ..... 439/64

(58) Field of Classification Search ..... 439/64.1, 439/76.1, 159–160, 630, 377, 564
See application file for complete search history.

(56) References Cited

U.S. PATENT DOCUMENTS 7,094,107 B2 * 8/2006 Wu et al. ..... 439/630
7,101,222 B2 * 9/2006 Ho et al. ..... 439/541.5
7,604,482 B2 * 10/2009 Shen et al. ..... 439/64
7,628,651 B2 12/2009 Yeh
2008/0081489 A1 * 4/2008 MacGregor et al. ..... 439/71
2008/0280462 A1 * 11/2008 Ho et al. ..... 439/64
2009/0093139 A1 * 4/2009 Cheng ..... 439/64

* cited by examiner

*Primary Examiner* — Jean F Duverne
(74) *Attorney, Agent, or Firm* — Andrew C. Cheng; Wei Te Chung; Ming Chieh Chang

(57) ABSTRACT

An electrical connector (4) comprises a frame (41) and a plurality of terminals (42) received in the frame. The frame comprises a first portion (410) defining a holding slot (4101), a second portion (411) extending angularly to the first portion and a retaining member (43) formed on the second portion. The terminals each has a contact section (425) and a solder tail (427) extending out of the frame. The plurality of terminals (42) are arranged two rows on the first portion (410) and one row on the second portion (411). The contact sections of two rows terminals on the first portion are located at opposite sides of the holding slot (4101) and the contact sections of one row terminals on the second portion expose to an outer surface of the second portion.

7 Claims, 8 Drawing Sheets

SINK TYPE ELECTRICAL CONNECTOR WITH L-SHAPED FRAME

BACKGROUNDING OF THE INVENTION

1. Field of the Invention

The present invention relates to an electrical connector for electrically connecting an electronic package with a circuit substrate, and more particularly to a sink type electrical connector with L-shaped frame.

2. Description of the Prior Art

A conventional electrical connector for electrically connecting an electronic package with a circuit substrate disclosed in U.S. Pat. No. 7,628,651 issued to Yeh on Dec. 8, 2009 includes an insulative housing and a retaining arrangement enclosing the insulative housing. The retaining arrangement includes a stiffener fixed on the circuit substrate, a clip pivotally mounted to the stiffener for retaining the electronic package and a lever pivotally mounted to the stiffener. The electrical connector is mounted on the circuit substrate and the electronic package is assembled on the insulative housing. The electrical connector has a complicated and high configuration not meeting needs of small and thin electronic equipments.

In view of the above, an improved electrical connector that overcomes the above-mentioned disadvantages is desired.

SUMMARY OF THE INVENTION

Accordingly, an object of the present invention is to provide a sink type electrical connector having L-shaped frame.

To fulfill the above-mentioned object, an electrical connector comprises a frame and a plurality of terminals received in the frame. The frame comprises a first portion defining a holding slot, a second portion extending angularly from the first portion and a retaining member formed on the second portion. The terminals each has a contact section and a solder tail extending out of the frame. The plurality of terminals are arranged two rows on the first portion and one row on the second portion. The contact sections of two rows terminals on the first portion are located at opposite sides of the holding slot and the contact sections of one row terminals on the second portion expose to an outer surface of the second portion. The present invention also provides an electrical connector assembly comprising a circuit substrate with an opening, the electrical connector sinking in the opening and an electronic package assembled to the electrical connector.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
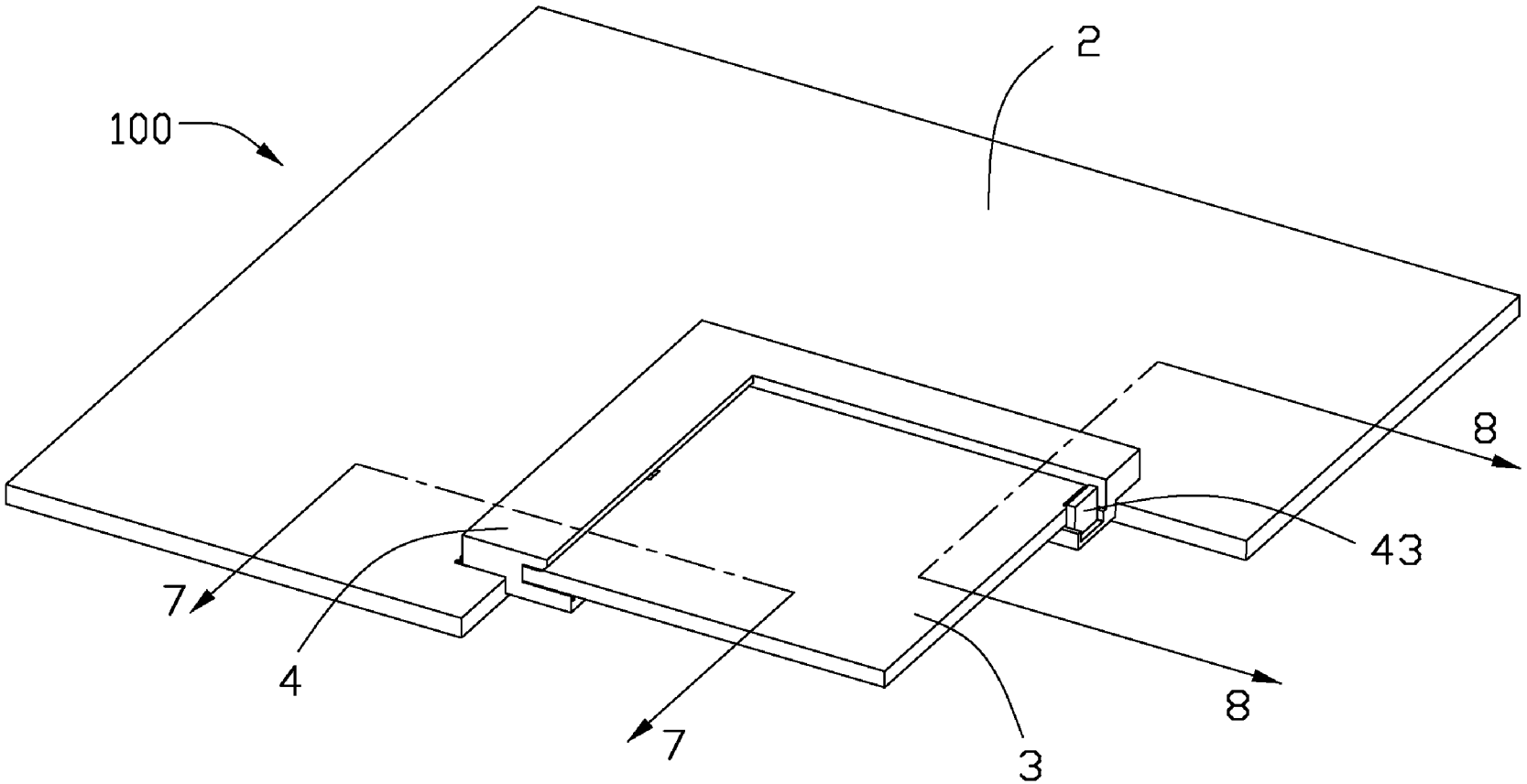
FIG. 1 is an assembled, perspective view of an electrical connector assembly in accordance with a preferred embodiment of the present invention.
Figure 2:
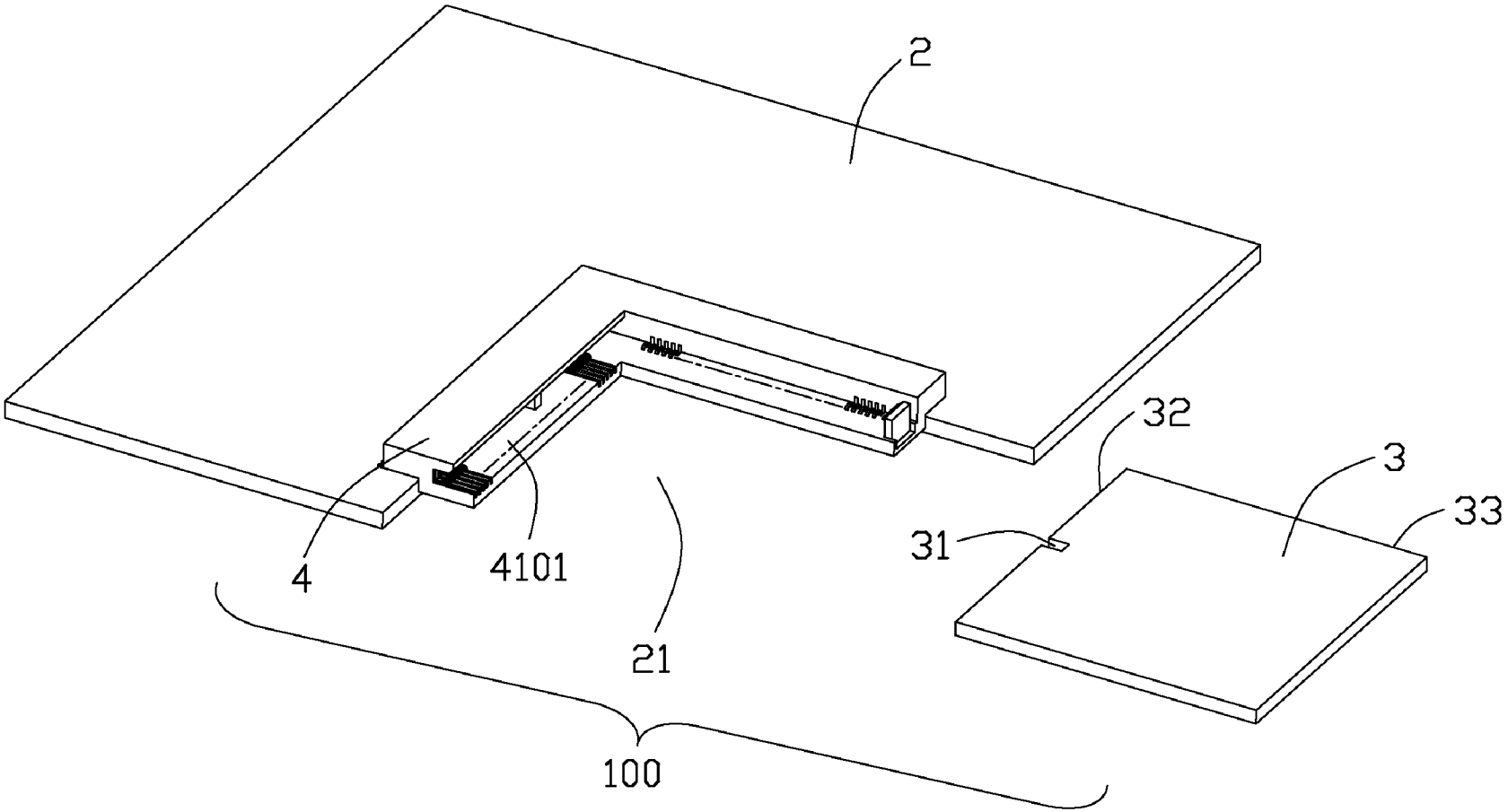
FIG. 2 is an exploded, perspective view of the electrical connector assembly shown in FIG. 1, showing the electronic package detached from the electrical connector.

Referring to FIGS. 1 and 2, an electrical connector assembly 100 comprises a circuit substrate 2 defining a rectangle opening 21, an electrical connector 4 mounted in the rectangle opening 21 and an electronic package 3 assembled to the electrical connector 4. The electrical connector 4 electrically connects the electronic package 3 to the circuit substrate 2.

Figure 3:
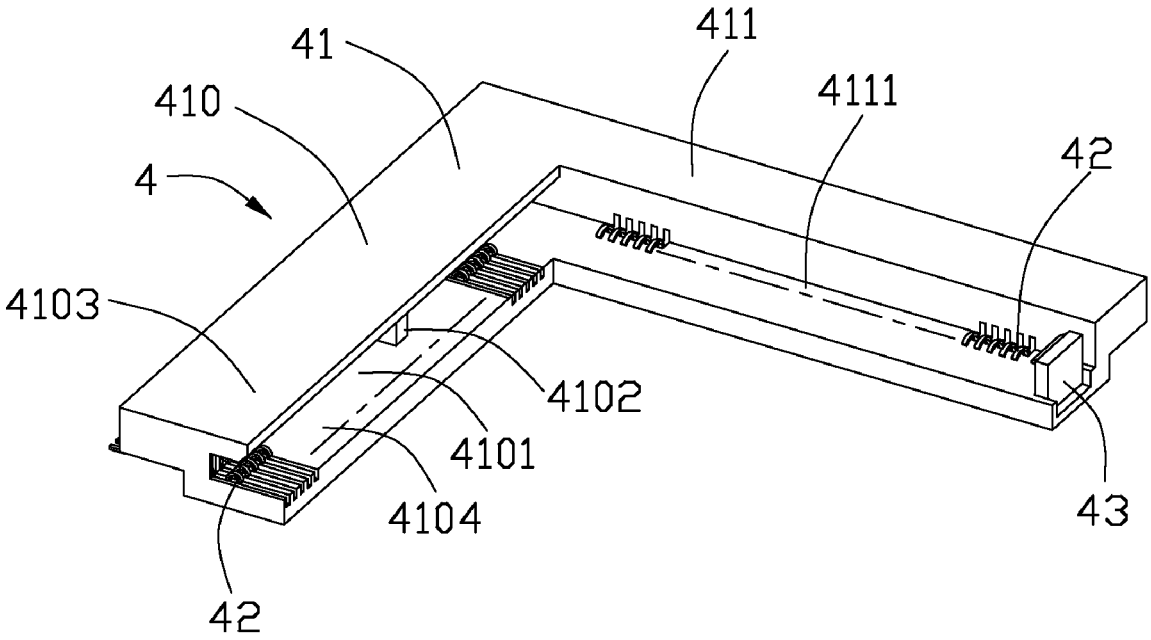
FIG. 3 is a front assembled, perspective view of the electrical connector shown in FIG. 1.
Figure 4:
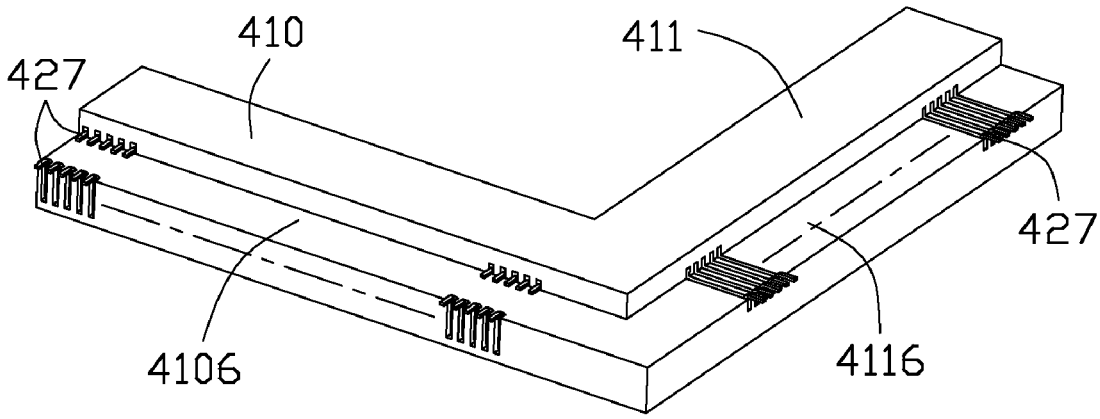
FIG. 4 is a rear assembled, perspective view of the electrical connector shown in FIG. 3.
Figure 5:
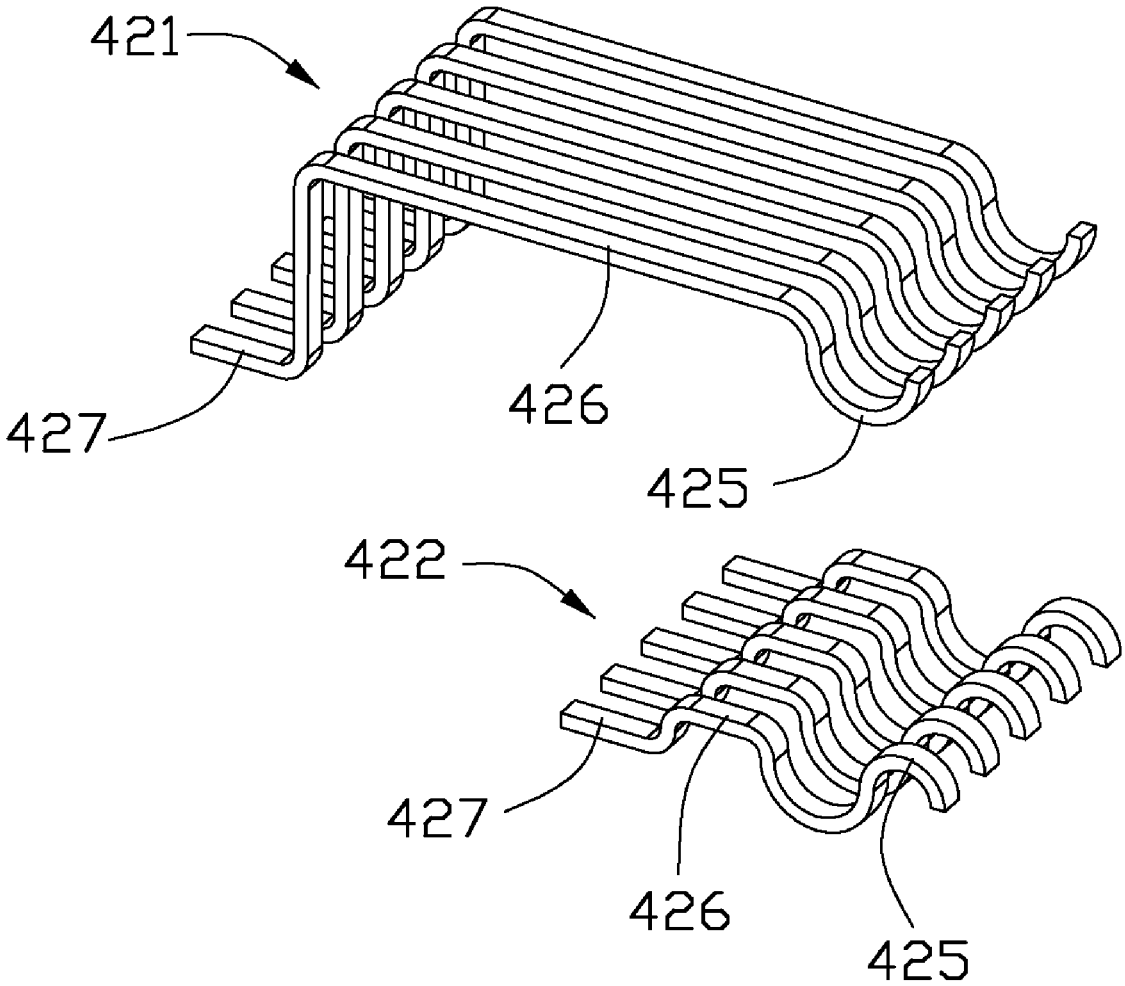
FIG. 5 is a perspective view of a row of first terminals and a row of second terminals of the electrical connector shown in FIG. 3.
Figure 6:
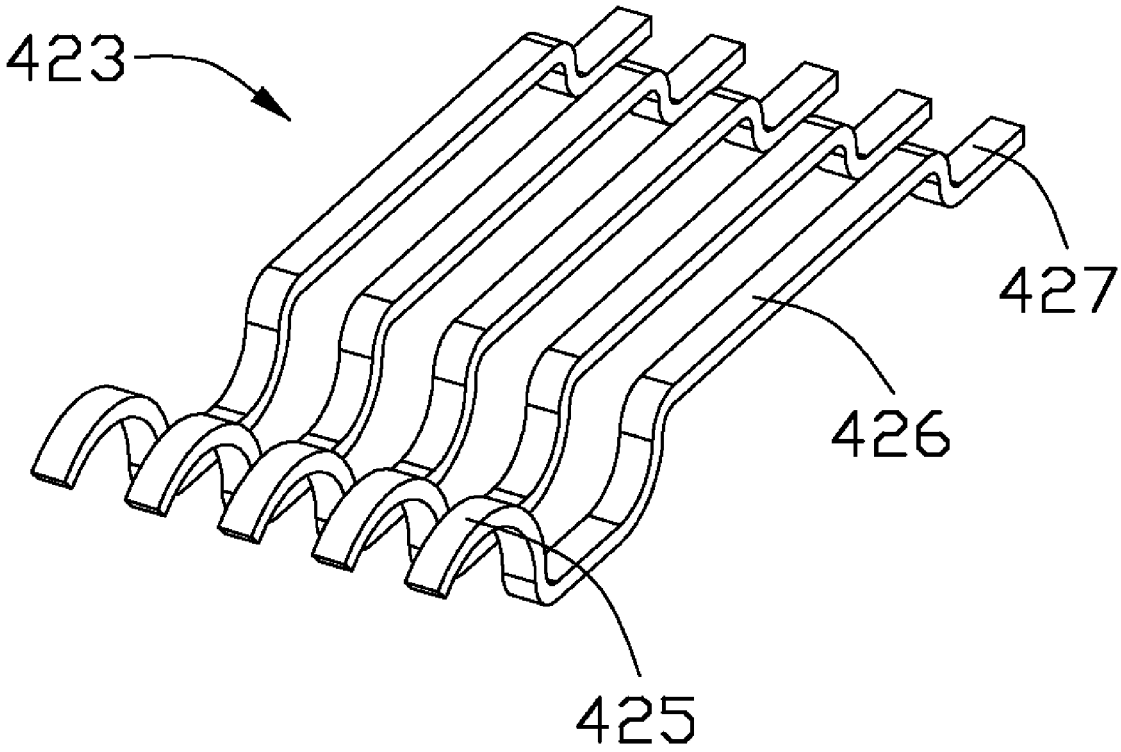
FIG. 6 is a perspective view of a row of third terminals of the electrical connector shown in FIG. 3.

Referring to FIGS. 2 to 4, the electrical connector 4 comprising a frame 41 and a plurality of terminals 42 received in the frame 41. The frame 41 is L-shaped and has a first portion 410 with a holding slot 4101, a second portion 411 perpendicular to the first portion 410 and a retaining member 43 formed on the second portion 411. The retaining member 43 locates on one end of the second portion 411 and faces the first portion 410. In this embodiment, the retaining member 43 is a spring hook. Both the first portion 410 and the second portion 411 have a step section 4106, 4116 recessed from a bottom surface thereof so that the frame 41 sinks downwardly into the rectangle opening 21 of the circuit substrate 2.

Figure 7:
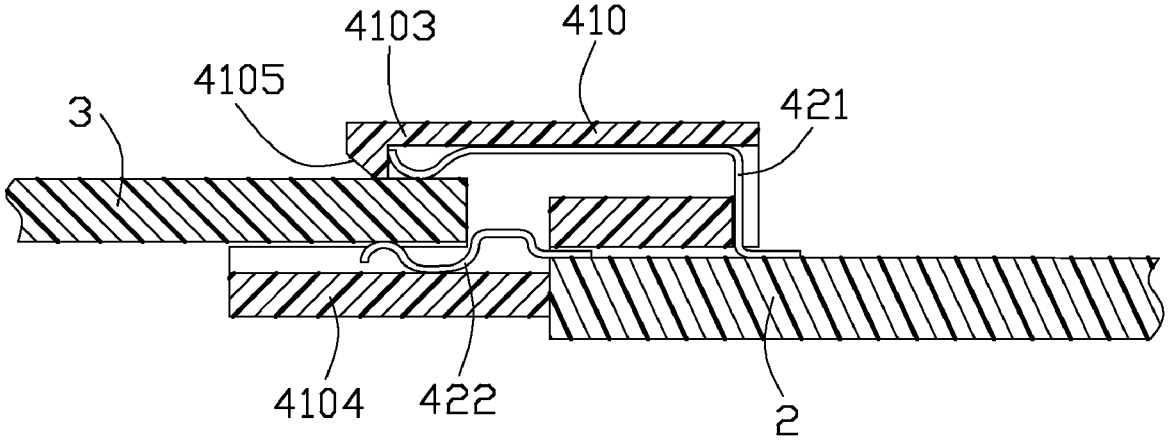
FIG. 7 is a cross-sectional view taking along line 7-7 shown in FIG. 1.
Figure 8:
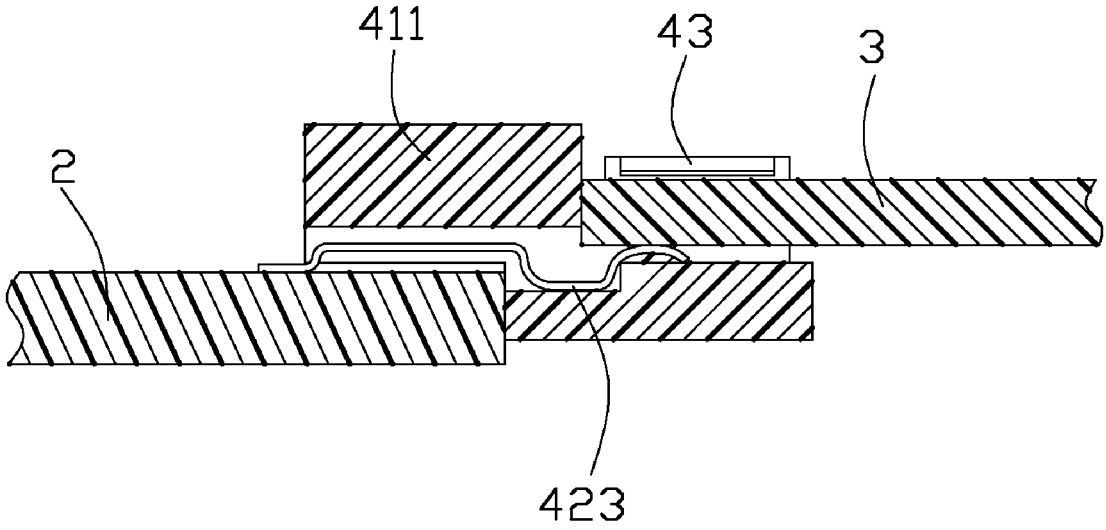
FIG. 8 is a cross-sectional view taking along line 8-8 shown in FIG. 1.

The holding slot 4101 laterally opens and a guiding emboss 4102 projects therein. The electronic package 3 has a guiding cutout 31 corresponding to the guiding emboss 4102 for guiding the electronic package 3 inserting into the frame 41. With referring to FIG. 7, the first portion 410 has an upper wall 4103 with a chamfer 4105 for facilitating the electronic package 3 inserting into the holding slot 4101 and a lower wall 4104 projecting beyond the upper wall 4103 for supporting the electronic package 3. With referring to FIG. 8, the second portion 411 has a lower wall 4111 to support the electronic package 3.

Referring to FIGS. 5 to 8, the terminals 42 are retained in the first portion 410 and the second portion 411 of the frame 41 and comprise a row of first terminals 421 received in the upper wall 4103 of the holding slot 4101, a row of second terminals 422 received in the lower wall 4104 of the holding slot 4101 and a row of third terminals 423 received in the second portion 411. The three kinds of terminals 421, 422, 423 have similar configurations and each includes a spring contact section 425 extending out of the frame 41 for electrically connecting to the electronic package 3, a retaining section 426 retaining in the frame 41 and a soldering tail 427 extending out of the frame 41 for soldering on the circuit substrate 2. The soldering tails 427 are arranged on the step sections 4106, 4116 of the first and second portions 410, 411. The spring contact sections 425 of the first and second terminals 421, 422 project in the holding slot 4101 and the spring contact sections 425 of the third terminals 423 exposes on an outer surface of the second portion 411.

Referring to FIGS. 1 and 2, in assembly, the electrical connector 4 is mounted on the circuit substrate 2. The guiding cutout 31 engages with the guiding emboss 4102 until the electronic package 3 is locked by the retaining member 43. Then, a first edge 32 of the electronic package 3 is inserted into the holding slot 411 and sandwiched by the first and second terminals 421, 422. A second edge 33 of the electronic package 3 is pressed on the third terminals 423. Since the second edge 33 is not sandwiched by two of terminals as the first edge 32, the retaining member 43 can ensure the electrical connection between the second edge 33 and the third terminals 423. The electrical connector 4 has a simple and low configuration meeting needs of small and thin electronic equipments.

While preferred embodiment in accordance with the present invention has been shown and described, equivalent modifications and changes known to persons skilled in the art according to the spirit of the present invention are considered within the scope of the present invention as defined in the appended claims.

What is claimed is:

1. An electrical connector comprising:

a frame comprising a first portion defining a holding slot, a second portion extending angularly from the first portion and a retaining member formed on the second portion; and a plurality of terminals received in the frame and each defining a contact section and a solder tail extending out of the frame, the plurality of terminals being arranged two rows on the first portion and one row on the second portion, the contact sections of said two rows terminals on the first portion being located at opposite sides of the holding slot, the contact sections of said one row terminals on the second portion exposed to an outer surface of the second portion; wherein the retaining member extends upwardly from one end of the second portion and faces the first portion, and the retaining member has a hook; wherein both the first portion and the second portion have a step section recessed from a bottom surface thereof, and the soldering tails of the terminals are arranged on the step sections; wherein the first portion has an upper wall and a lower wall opposite to each other thereby forming the holding slot therebetween, and wherein the lower wall projects beyond the upper wall and the holding slot; wherein the upper wall has a guiding emboss projects into the holding slot.

2. The electrical connector as claimed in claim 1, wherein the second portion is perpendicular to the first portion.

3. An electrical connector assembly comprising:

a circuit substrate defining an opening;

an electrical connector comprising a frame and a plurality of terminals received in the frame, the terminals each having a contact section and a soldering tail, the frame having a first portion and a second portion extending angularly from the first portion, the first portion and the second portion each having a sink section received in the opening and a step section located on the circuit substrate, and the soldering tails arranged on the step sections and soldering on the circuit substrate; and an electronic package attached to the first portion and the second portion and electrically connecting with the terminals; wherein the frame defines a holding slot and the plurality of terminals are arranged two rows on the first portion and one row on the second portion, the contact sections of said two rows terminals on the first portion being located at opposite sides of the holding slot, the contact sections of said one row terminals on the second portion exposed to an outer surface of the second portion; wherein a first edge of the electronic package is inserted into the holding slot and sandwiched by said two rows of terminals, and a second edge of the electronic package contacts with the terminals by a single side; wherein the first portion has an upper wall and a lower wall opposite to each other thereby forming the holding slot therebetween, and wherein the lower wall projects beyond the upper wall and the holding slot; wherein the upper wall has a guiding emboss projects into the holding slot.

4. The electrical connector assembly as claimed in claim 3, wherein the frame also has a retaining member extending upwardly form one end of the second portion and faces the first portion, the retaining member having a hook to lock the electronic package.

5. The electrical connector assembly as claimed in claim 3, wherein the second portion is perpendicular to the first portion.

6. An electrical connector assembly for use with an electronic package, comprising:

an insulative housing defining an L-shaped configuration in a top view, said L-shaped configuration including a transverse section and a longitudinal section respectively extending along a transverse direction and a longitudinal direction perpendicular to said transverse direction, and further linked to each other via corresponding ends;

a first set of contacts disposed in the transverse section;

a second set contacts disposed in the longitudinal section;

a first restriction device formed on the transverse section and restricting movement of the electronic package in the transverse direction; and a second restriction device formed on the longitudinal section and restricting movement of the electronic package in the longitudinal direction ; further including a printed circuit board defining an cutout horizontally communicating with an exterior in both said transverse direction and said longitudinal direction, wherein said housing is essentially aligned with an intersection corner of said cutout and essentially received in the cutout; wherein said housing defines a mounting face seated upon an upper face of the printed circuit board, under condition that at least one set of said first and second sets of contacts defines soldering sections seated upon said upper face, and contacting sections having a same level with said solder sections.

7. The electrical connector assembly as claimed in claim 6, wherein said electronic package defines a guiding cutout receiving a key on the transverse section under condition that said key is the first restriction device.

* * * * *